US011052442B2

(12) United States Patent
Kitazawa et al.

(10) Patent No.: US 11,052,442 B2
(45) Date of Patent: Jul. 6, 2021

(54) COPPER-COATED MAGNESIUM WIRE AND METHOD FOR MANUFACTURING THE SAME

(71) Applicant: TOTOKU ELECTRIC CO., LTD., Tokyo (JP)

(72) Inventors: Hiroshi Kitazawa, Ueda (JP); Takuya Sakita, Ueda (JP)

(73) Assignee: TOTOKU ELECTRIC CO., LTD, Tokyo (JP)

( * ) Notice: Subject to any disclaimer, the term of this patent is extended or adjusted under 35 U.S.C. 154(b) by 269 days.

(21) Appl. No.: 16/301,486

(22) PCT Filed: Mar. 22, 2017

(86) PCT No.: PCT/JP2017/011358
§ 371 (c)(1),
(2) Date: Nov. 14, 2018

(87) PCT Pub. No.: WO2017/221485
PCT Pub. Date: Dec. 28, 2017

(65) Prior Publication Data

US 2019/0283097 A1 Sep. 19, 2019

(30) Foreign Application Priority Data

Jun. 21, 2016 (JP) ..... JP2016-122825

(51) Int. Cl.
*B21C 1/02* (2006.01)
*B21C 1/00* (2006.01)
(Continued)

(52) U.S. Cl.
CPC ..... *B21C 1/003* (2013.01); *B21C 1/00* (2013.01); *C25D 7/06* (2013.01); *H01B 5/02* (2013.01);
(Continued)

(58) Field of Classification Search
None
See application file for complete search history.

(56) References Cited

FOREIGN PATENT DOCUMENTS

JP 56-26687 A 3/1981
JP 11-66966 A 3/1999
(Continued)

OTHER PUBLICATIONS

International Search Report for PCT/JP2017/011358 dated, Apr. 18, 2017 (PCT/ISA/210).
(Continued)

*Primary Examiner* — Daniel J. Schleis
(74) *Attorney, Agent, or Firm* — Sughrue Mion, PLLC

(57) ABSTRACT

To provide a copper-coated magnesium wire which meets the demand for a lightweight coil wire material, and a method for manufacturing the same. The above-described problem is solved by a copper-coated magnesium wire (10) comprising a core material (1) made of magnesium, and a copper coating layer (2) made of copper or a copper alloy provided on a surface of the core material (1). In the copper-coated magnesium wire (10), a wire drawing mark is present on a surface of the copper coating layer (2), and the diameter is preferably within a range of 0.03 to 0.08 mm, inclusive. Further, a thickness of the copper coating layer (2) is preferably within a range of 5 to 30%, inclusive, as a ratio of the overall cross-sectional area. An insulating coating layer (3) may be provided on an outer circumferential side of the copper coating layer (2).

5 Claims, 3 Drawing Sheets

(51) Int. Cl.

| | |
|---|---|
| ***C25D 7/06*** | (2006.01) |
| ***H01B 5/02*** | (2006.01) |
| ***H01B 13/00*** | (2006.01) |

(52) U.S. Cl.
CPC ..... *H01B 13/00* (2013.01); *B21C 1/02* (2013.01); *Y10T 428/12438* (2015.01)

(56) References Cited

FOREIGN PATENT DOCUMENTS

| | | | |
|---|---|---|---|
| JP | 2001-271198 | A | 10/2001 |
| JP | 2016-76491 | A | 5/2016 |
| JP | 2016076491 | * | 5/2016 |

OTHER PUBLICATIONS

Written Opinion for PCT/JP2017/011358 dated, Apr. 18, 2017 (PCT/ISA/237).

* cited by examiner

COPPER-COATED MAGNESIUM WIRE AND METHOD FOR MANUFACTURING THE SAME

CROSS REFERENCE TO RELATED APPLICATIONS

This application is a National Stage of International Application No. PCT/JP2017/011358 filed Mar. 22, 2017, claiming priority based on Japanese Patent Application No. 2016-122825 filed Jun. 21, 2016, the disclosure of which is incorporated herein in its entirety by reference.

FIELD OF THE INVENTION

The present invention relates to a copper-coated magnesium wire and a method for manufacturing the copper-coated magnesium wire.

BACKGROUND ART

Coils such as a coil used in a voice coil motor, a coil used in an optical pickup lens driving actuator, an air-core coil, and a voice coil have required weight reductions. While various techniques have been proposed as weight reduction techniques, one such technique is to reduce the weight of the electric wire.

Conventionally, to reduce the weight of the electric wire, there has been proposed a composite aluminum wire that uses aluminum having a specific gravity that is approximately one-third that of copper (Patent Documents 1 to 3).

In Patent Document 1 there is proposed a technique for improving a bonding strength of a copper-aluminum composite material by providing a nickel layer at an interface between the copper and the aluminum or aluminum alloy. In this document, there is also proposed a copper clad aluminum wire via nickel, and described a method for rolling and pressing two copper-nickel composite strips on the circumference of the aluminum wire as well as a method for seam-welding a single copper-nickel composite strip on the circumference of the aluminum wire.

In Patent Document 2 there are proposed a plated aluminum electric wire as well as an insulation-plated aluminum electric wire that enable weight reduction, and a technique for efficiently manufacturing the wires. In this technique, an insulation-plated aluminum electric wire is obtained by sequentially providing an anchor conductive layer comprising a composite conductive material made of conductive particles or flakes and a polymer matrix, a highly conductive metal layer comprising a strike plating layer made by electroplating and a thick plating layer, and an insulating coating layer on an outer circumference of an aluminum conductor or an aluminum alloy conductor.

In Patent Document 3 there is proposed a technique related to a copper-coated aluminum wire that prevents the occurrence of fine cracks caused by a stress received by a copper film during a drawing process, solves the problem of susceptibility of the aluminum conductor to exposure during coil winding, achieves sufficient reliability of soldered joints, and is suitable for miniaturization. In this technique, a copper-coated aluminum wire is obtained by first forming a matte copper plating layer as the copper plating layer by electrolytic copper plating on an outer circumference of a zinc thin film formed by zinc substitution on a surface of a conductor made of aluminum, and then forming a semi-gloss copper plating layer by adding a thiourea-based additive or the like during electrolytic copper plating on this outer circumference.

PATENT DOCUMENTS

Patent Document 1: Japanese Laid-Open Patent Application No. S56-26687

Patent Document 2: Japanese Laid-Open Patent Application No. H11-66966

Patent Document 3: Japanese Laid-Open Patent Application No. 2001-271198

SUMMARY OF THE INVENTION

Problems to be Solved by the Invention

The wire materials described in Patent Documents 1 to 3 are each a composite wire provided with aluminum as a core material and copper in the outer layer, exhibit the lightness of the aluminum as well as the solderability and corrosion resistance of the copper, and meet the demand for weight reduction in coil products and the like. On the other hand, while a reduction in the diameter of the wire material has also been required due to miniaturization of the coil in recent years, a copper-coated aluminum wire has a tensile strength that is considerably small compared to that of a copper wire, resulting in the possibility of breakage during coil winding and a decrease in yield. Further, when breakage readily occurs, complications in work, that is, the need to adjust the winding tension, arise.

It is therefore an object of the present invention is to provide a copper-coated magnesium wire that meets the demand for a coil wire material that is light in weight and high in strength, and a method for manufacturing the copper-coated magnesium wire.

Means for Solving the Problems (1) A copper-coated magnesium wire according to the present invention comprises a core material made of magnesium, and a copper coating layer made of copper or a copper alloy provided on a surface of the core material.

According to the present invention, magnesium, which has about the same as the tensile strength of copper and approximately one-fourth the specific gravity of copper, is used as the core material, and thus a coil wire material that is light in weight and high in strength is achieved. Further, because the copper coating layer made of copper or a copper alloy is provided on the outer circumferential surface of the core material made of magnesium, the structure allows the magnesium, for which cold wire-drawing is difficult, to be thinned, making it possible to obtain a coil wire material having a smaller diameter. As a result, hot wire-drawing using dedicated equipment is not required, and cold drawing using typical cold wire-drawing equipment can be performed, resulting in an advantage in terms of cost as well. In particular, the copper-coated magnesium wire is preferably used as a lightweight voice coil wire material when the diameter of the wire material requires reduction due to miniaturization of the coil.

In the copper-coated magnesium wire according to the present invention, the copper coating layer comprises a surface with wire drawing marks, and the copper-coated magnesium wire has a diameter within a range of 0.03 to 0.08 mm, inclusive.

In the copper-coated magnesium wire according to the present invention, the copper coating layer has a thickness within a range of 5 to 30%, inclusive, as a ratio of the overall cross-sectional area.

In the copper-coated magnesium wire according to the present invention, the copper coating layer is provided with an insulating coating layer on an outer circumferential side thereof.

(2) A method for manufacturing a copper-coated magnesium wire according to the present invention is a method for manufacturing a copper-coated magnesium wire comprising a core material made of magnesium, and a copper coating layer made of copper or a copper alloy provided on a surface of the core material and having a ratio of the overall cross-sectional area within a range of 5 to 30%, inclusive, the method comprising the steps of preparing a copper-coated magnesium element wire provided with a copper coating layer made of copper or a copper alloy on an outer circumference of a magnesium element wire, and cold-drawing the copper-coated magnesium element wire to a diameter within a range of 0.03 to 0.08 mm, inclusive.

Effect of the Invention

According to the present invention, it is possible to meet the demand for a coil wire material that is light in weight, and high in strength, and reduce the diameter of a coil wire material that is as light in weight as a copper-coated aluminum wire and higher in strength than a copper-coated aluminum wire by cold drawing using regular equipment.

EMBODIMENTS OF THE INVENTION

Hereinafter, a copper-coated magnesium wire and a manufacturing method thereof according to the present invention will be described with reference to the drawings. Note that the present invention is not limited to the illustrated embodiments.

Figure 1:
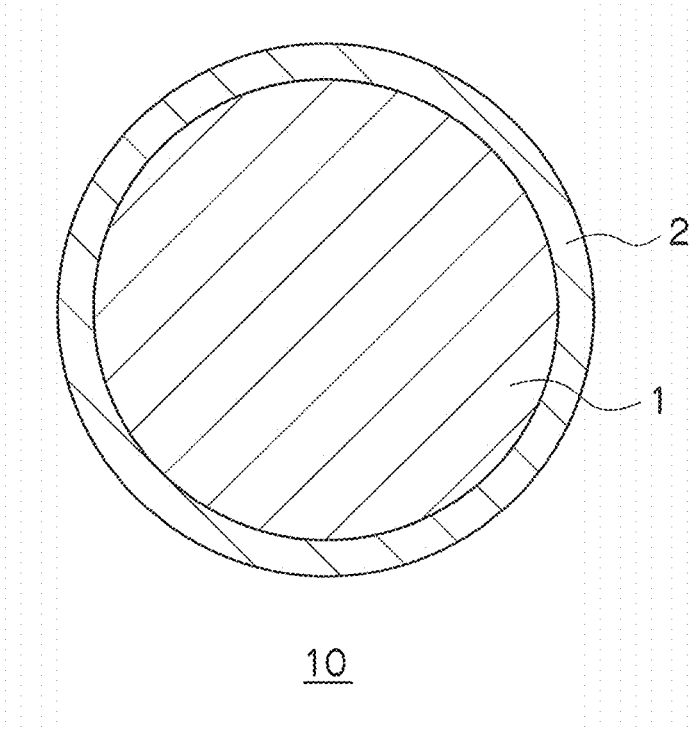
FIG. 1 is a cross-sectional view illustrating an example of a copper-coated magnesium wire according to the present invention.
Figure 2:
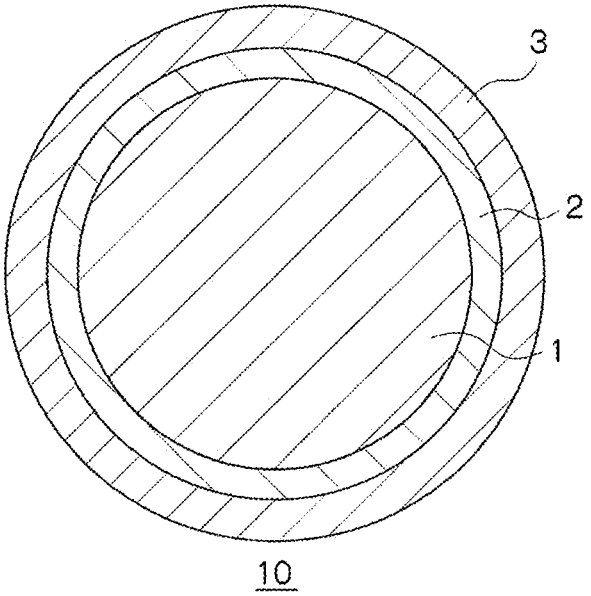
FIG. 2 is a cross-sectional view illustrating another example of the copper-coated magnesium wire according to the present invention.

A copper-coated magnesium wire 10 according to the present invention, as illustrated in FIG. 1 and FIG. 2, comprises a core material 1 made of magnesium, and a copper coating layer 2 made of copper or a copper alloy provided on a surface of the core material 1.

In this copper-coated magnesium wire 10, magnesium, which has about the same as the tensile strength of copper and approximately one-fourth the specific gravity of copper, is used as the core material 1, and thus a coil wire material that is light in weight and high in strength is achieved. Further, because the copper coating layer 2 made of copper or a copper alloy is provided on the outer circumferential surface of the core material 1, the structure allows the magnesium, for which cold wire-drawing is difficult, to be thinned. As a result, the coil wire material has a smaller diameter. The copper-coated magnesium wire 10 does not require hot drawing using dedicated equipment such as when a magnesium wire is processed, and can be cold-drawn using typical cold wire-drawing equipment, resulting in an advantage in terms of cost as well. In particular, the copper-coated magnesium wire is preferably used as a lightweight voice coil wire material when the diameter of the wire material requires reduction due to miniaturization of the coil.

Below, the components of the copper-coated magnesium wire are described in detail.

(Core material)

The core material 1 is configured by magnesium. Here, "magnesium" is used in the sense of pure magnesium, and not a magnesium alloy obtained by intentionally adding another element. The magnesium (pure magnesium) contains a magnesium component in an amount of at least 99.0 mass % without the intentional addition of other elements. Magnesium is defined under "Magnesium ingots" in Japanese Industrial Standard (JIS) H 2150 (2006), and the international standard corresponding thereto is ISO 8287 (2000). Examples include magnesium ingot class 1-A (Mg: 99.95 mass % or greater, symbol: MI1A Mg, corresponding ISO symbol: 99.95 A), magnesium ingot class 1-B (Mg: 99.95 mass % or greater, symbol: MI1B Mg, corresponding ISO symbol: 99.95B), magnesium ingot class 2-MI2 (Mg: 99.90 mass % or greater), magnesium ingot class 3-A (Mg: 99.80 mass % or greater, symbol: MI3A Mg, corresponding ISO symbol: 99.80 A), and magnesium ingot class 3-B (Mg: 99.80 mass % or greater, symbol: MI3B Mg, corresponding ISO symbol: 99.80B).

Examples of inevitable impurities contained in the magnesium described above, as stated in JIS H 2150 (2006), include manganese, iron, silicon, copper, nickel, calcium, and the like. As an example, magnesium ingot class 1-A contains as inevitable impurities up to 0.01 mass % of aluminum, 0.006 mass % of manganese, 0.005 mass % of zinc, 0.006 mass % of silicon, 0.005 mass % of copper, 0.003 mass % of iron, 0.001 mass % of nickel, 0.005 mass % of lead, 0.005 mass % of tin, 0.003 mass % of sodium, 0.003 mass % of calcium, 0.01 mass % of titanium, and 0.005 mass % of other elements.

The magnesium described above has a conductivity within a range of approximately 35 to 45% when the conductivity of copper is 100%, resulting in no significant difference compared to approximately 60% for aluminum or approximately 66% for copper clad aluminum (CCA). As a result, the magnesium can be preferably used as a coil wire material such as a lightweight voice coil.

On the other hand, an AZ-based magnesium alloy containing 3% Al-1% Zn, such as AZ31B or AZ31M in ASTM symbols, has a low conductivity, such as approximately 15 to 20%. Further, AZ-based magnesium alloy containing 9% Al-1% Zn, such as AZ91 in ASTM symbols, has a lower conductivity. Such a magnesium alloy is unsuitable for use as a conductive wire, and is not very desirable as a coil wire material.

The tensile strength of magnesium is approximately 180 to 250 MPa, which is considerably large compared to the tensile strength of aluminum (approximately 68 to 107 MPa) and about the same as the tensile strength of copper (approximately 215 to 264 MPa). Further, magnesium has a specific gravity (approximately 1.74) that is approximately one-fourth the specific gravity of copper (approximately 8.89), and is lightweight. The use of such magnesium as the core material 1 is preferred for the configuration of a coil wire material having strength for the manufacture of a lightweight coil.

(Copper Coating Layer)

The copper coating layer 2 is a layer of copper or a copper alloy provided on the surface of the core material 1. Since copper or a copper alloy is provided on the surface of the core material 1, the layer is obtained by easy cold wire-drawing. Examples of the copper include pure copper, and examples of the copper alloy include a copper-silver alloy, a copper-nickel alloy, a copper-zinc alloy, and the like. The copper-silver alloy is a copper alloy containing about 0.5 mass % of silver. The copper-nickel alloy is a copper alloy containing about 1 mass % of nickel. The copper-zinc alloy is a copper alloy containing about 5 mass % of zinc. These copper alloys each have a conductivity within a range of approximately 80 to 95% when the conductivity of copper is 100%, and can be preferably applied.

A thickness of the copper coating layer 2, while not particularly limited, is preferably within a range of 5 to 30%, inclusive, as a ratio of the overall cross-sectional area of the copper-coated magnesium wire 10 provided with the copper coating layer 2 on the surface of the core material 1. As illustrated in the examples described later, with the thickness being within this range of the ratio of the cross-sectional area, the conductivity is approximately 43 to 58%, which is a conductivity close to the approximate 60% for an aluminum wire and the approximate 66% for a copper clad aluminum (CCA) wire, and thus the copper-coated magnesium wire can be preferably used as a coil wire material. Note that, when the conductivity and weight (specific gravity) as a coil wire material for the manufacture of a lighter coil is considered, the preferred range is 5 to 25%, inclusive, as a ratio of the cross-sectional area.

When the copper coating layer 2 has a thickness less than 5% as a ratio of the cross-sectional area, the copper coating layer 2 may be exposed and susceptible to tearing during wire drawing in the manufacturing stage. As a result, breakage may readily occur, resulting in a decrease in yield, the surface may readily oxidize, and the soldering may deteriorate. On the other hand, when the copper coating layer 2 has a thickness greater than 30% as a ratio of the cross-sectional area, the proportion of the copper, which has a large specific gravity, increases, possibly increasing the weight, and uneven thickness in the plating layer may readily occur when the copper coating layer 2 is provided by plating.

Note that the specific thickness of the copper coating layer 2 differs depending on the diameter of the copper-coated magnesium wire 10. For example, when the copper-coated magnesium wire 10 has a diameter of 0.08 mm, the thickness of the copper coating layer 2 is about 1.0 μm when the ratio of the cross-sectional area is 5%, and about 6.5 μm when the ratio of the cross-sectional area is 30%.

Figure 3A:
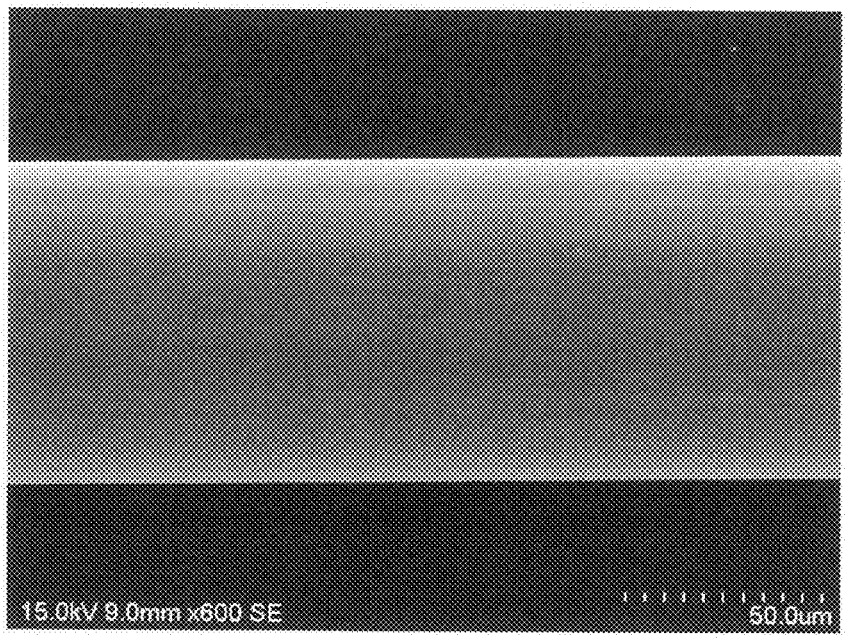
FIGS. 3A and 3B are images showing wire drawing marks on a surface of a copper coating layer.
Figure 3B:
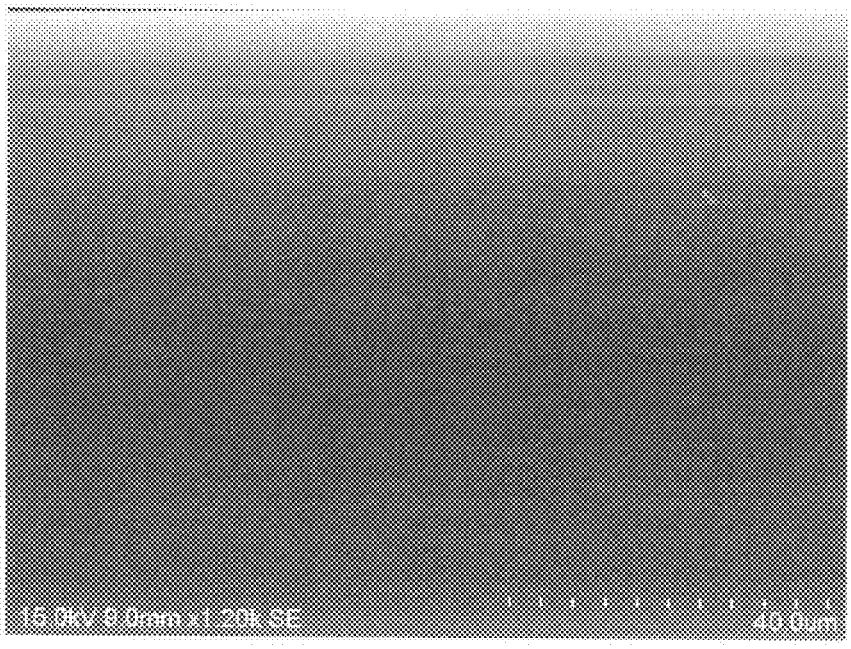

The copper coating layer 2 is provided by applying copper plating or the like on a surface of a magnesium element wire 1' prior to drawing. The copper coating layer 2 is subsequently wire-drawn and provided at a thickness of a predetermined ratio of the cross-sectional area. On a surface of the copper coating layer 2 thus wire-drawn, there are wire drawing marks extending in a longitudinal direction such as illustrated in the enlarged views of FIG. 3A and FIG. 3B. From these wire drawing marks, it is understood that the copper-coated magnesium wire 10 according to the present invention has been reduced in diameter by drawing. Note that, when the copper coating layer 2 is provided by copper plating, the adhesion between the magnesium and the copper plating layer increases, increasing the closeness therebetween, resulting in the advantage that both stripping and breakage is unlikely to occur during wire drawing. When the copper coating layer is temporarily provided by welding, the magnesium is readily oxidized by the heat during welding, decreasing the adhesion and making it impossible to perform uniform wire drawing.

While the copper coating layer 2 is provided on the surface of the core material 1, other elements may be detected between the copper coating layer 2 and the core material 1 within a range that does not hinder the effects of the present invention. The copper coating layer 2 is provided by performing a zincate treatment and then thickly plating the copper. Normally, because the strike copper plating layer and the thick copper plating are applied after the zincate treatment, zinc elements may be detected as the other elements. Further, electroless nickel plating may be applied after the zincate treatment, followed by thick copper plating. In this case, examples of other elements include Ni, P, Pd, and the like.

Such a copper-coated magnesium wire 10 preferably has a diameter within a range of 0.03 to 0.08 mm, inclusive. With the diameter set within this range, the wire can be preferably used as a coil wire material such as a coil used in a voice coil motor, a coil used in an optical pickup lens driving actuator, an air-core coil, or a voice coil.

(Insulating Coating Layer)

An insulating coating layer 3, while not an essential configuration, is provided directly or via another layer on the outer circumference of the copper coating layer 2, as illustrated in FIG. 2. With the copper-coated magnesium wire 10 comprising such an insulating coating layer 3, the copper-coated magnesium wire 10 can be used as a coil wire material, making it possible to perform coil winding easily. The insulating coating layer 3 is not particularly limited, and a conventionally known insulating coating layer may be applied. Examples include a baked coating, an extruded coating, a tape winding, and the like.

Examples of the material of the insulating coating layer 3 include thermosetting resins such as polyurethane resin, polyester resin, and polyester imide resin. Further, examples of other materials of the insulating coating layer 3 may include polyphenyl sulfide (PPS), ethylene-tetrafluoroethylene copolymer (ETFE), tetrafluoroethylene-hexafluoropropylene copolymer (FEP), fluorinated resin copolymer (perfluoroalkoxy fluororesin: PFA), polyether ether ketone (PEEK), polyethylene terephthalate (PET), polyamide (PA), polyphenyl sulfide (PPS), tetrafluoroethylene-hexafluoropropylene copolymer (FEP), and the like.

The insulating coating layer 3 may be a single layer or a laminated layer. When the insulating coating layer 3 is a laminated layer, the same resin layers described above or different resin layers may be provided. A thickness of the insulating coating layer 3, while not particularly limited regardless of whether a single layer or a laminated layer, is normally preferably 3.0 μm or greater.

(Manufacturing Method)

Figure 4:
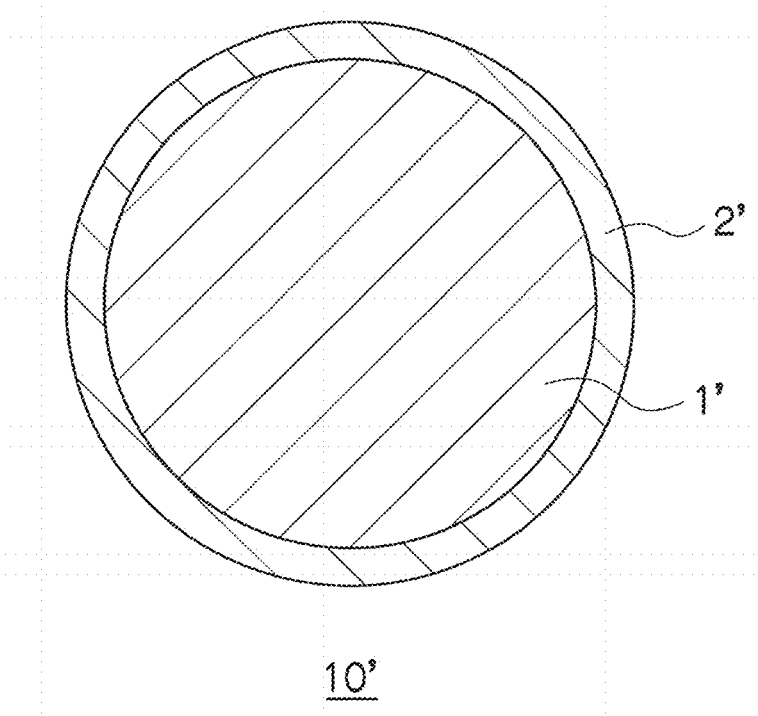
FIG. 4 is a schematic view of the copper-coated magnesium wire before drawing.

The method for manufacturing a copper-coated magnesium wire 10 according to the present invention is a method for manufacturing the copper-coated magnesium wire 10 comprising the core material 1 made of magnesium, and the copper coating layer 2 made of copper or a copper alloy within a range of 5 to 30%, inclusive, as a ratio of the cross-sectional area, and provided on the surface of the core material 1. Then, as illustrated in FIG. 4, the manufacturing method comprises the steps of preparing the copper-coated magnesium element wire 10' provided with a copper coating layer 2' made of copper or a copper alloy on an outer circumference of the magnesium element wire 1' (preparing step), and cold-drawing the copper-coated magnesium element wire 10' to a diameter within a range of 0.03 to 0.08 mm, inclusive (wire drawing step).

Note that manufactured copper-coated magnesium wire 10 and the core material 1, the copper coating layer 2, and the insulating coating layer 3 constituting the copper-coated magnesium wire 10 have already been described, and thus descriptions of overlapping portions will be omitted.

(Preparing Step)

The preparing step is a step of preparing a copper-coated magnesium element wire 10' provided with the copper coating layer 2' made of copper or a copper alloy on the outer circumference of the magnesium element wire 1'. The magnesium element wire 1', as illustrated in FIG. 4, is an element wire made of magnesium already described in the description section of the core material 1, and is obtained by processing cast magnesium in advance to a predetermined diameter. The diameter of the magnesium element wire 1' is not particularly limited, and thus an element wire that is subsequently easily drawn to a final finished wire diameter of 0.03 to 0.08 mm, inclusive, is preferably prepared. Examples include a magnesium element wire having a diameter of 0.6 mm such as illustrated in the example described later.

The copper coating layer 2' is provided to the prepared magnesium element wire 1'. The copper coating layer 2' is provided by applying copper plating on the outer circumferential surface of the 0.6-mm magnesium element wire 1', for example. While the copper plating treatment is not particularly limited, examples include zincate treatment followed by thick copper plating.

The copper plating via zincate treatment can be performed by a process of zinc substituting, strike copper plating, and thick copper plating, in that order, or a process of zinc substituting, zinc stripping, zinc substituting, strike copper plating, and thick copper plating, in that order. Further, electroless nickel plating may be performed after the zincate treatment, followed by thick copper plating. In this case, the copper plating via zincate treatment can be performed by a process of zinc substituting, electroless nickel plating, and thick copper plating, in that order, or a process of zinc substituting, zinc stripping, zinc substituting, electroless nickel plating, and thick copper plating, in that order. In this way, a final thick copper plating is applied. Examples of means for thick copper plating include copper cyanide plating, copper sulfate plating, copper-based (copper-zinc alloy, for example) alloy plating, and the like.

Taking into consideration the degree to which the diameter of the plated magnesium element wire 1' is drawn, the thick copper plating is provided to a thickness within a range of 5 to 30%, inclusive, as a ratio of the cross-sectional area at the final finished wire diameter. Thus, the copper-coated magnesium element wire 10' before drawing is prepared.

(Wire Drawing Step)

The wire drawing step is a step of cold-drawing the copper-coated magnesium element wire 10' to a diameter within a range of 0.03 to 0.08 mm, inclusive. The cold wire-drawing is preferably die-based drawing, and the wire is reduced to a desired diameter using a plurality of dies, depending on the degree of drawing. The copper-coated magnesium element wire 10' applied in the present invention is provided with the copper coating layer 2' on a surface thereof, and thus can be cold-drawn using typical cold wire-drawing equipment, making it possible to execute drawing without an excessive decrease in wire drawing speed. As a result, it is possible to reduce the diameter of the copper-coated magnesium wire 10 with high productivity.

Note that, with simply the magnesium element wire not provided with a copper coating layer, the processability thereof is poor, making diameter reduction difficult. The conventional diameter reduction means for magnesium required hot drawing while the diameter is thick, and frequent heat treatments (annealing) in the middle of cold drawing once the diameter is thin. Thus, the drawing of copper wire and the like by regular equipment has been difficult. In contrast, in the manufacturing method of the present invention, it is possible to draw copper wire and the like using regular equipment.

The copper-coated magnesium wire 10 thus drawn can be subsequently provided with the insulating coating layer 3 as necessary, and used as a coil wire material.

EXAMPLES

Below, the present invention is described in further detail through examples. Note that the present invention is not limited by the examples.

Example 1

As the magnesium element wire 1', a magnesium wire processed from magnesium ingot class 1-A (Mg: 99.95 mass % or greater) to a diameter of 0.6 mm was used. The copper coating layer 2' was provided on the outer circumferential surface of the magnesium element wire 1'. The copper coating layer 2' was subjected to zincate treatment. Specifically, the magnesium element wire 1' was subjected to degreasing, etching, desmutting (removal of a fine-powdered black substance and the like adhered to the surface), zinc substituting, zinc stripping, zinc substituting, strike copper plating, and thick copper plating, in that order. In the zinc substitution (first and second), the magnesium wire 1' was immersed in a zincate bath (50° C.) of 100 g/L of zinc oxide and 400 g/L of sodium hydroxide for 5 minutes to precipitate zinc having a thickness of 0.2 μm. Subsequently, the zinc was stripped using a zinc release agent (nitric acid), and the same zinc substitution as described above was performed once again (a second time). Subsequently, thin copper plating of a thickness of 1 μm was performed by strike copper plating (composition: 30 g/L of copper cyanide, 60 g/L of sodium cyanide, 60 g/L of Rochelle salt, and 30 g/L of alkaline carbonate), and lastly thick copper plating of a thickness of 24 μm (composition: 200 g/L of copper sulfate, 60 g/L of sulfuric acid, and 5 ml/L of an additive) were performed. Thus, the copper-coated magnesium element wire 10' having a diameter of 0.65 mm was prepared. The ratio of the cross-sectional area of the copper coating layer 2' with respect to the total cross-sectional area at this time was 15%.

After heat treatment (for 3 minutes) at 400° C., the copper-coated magnesium element wire 10' was cold-drawn to a diameter of 0.08 mm to obtain the copper-coated magnesium wire 10. The ratio of the cross-sectional area of the copper coating layer 2 to the total cross-sectional area of the obtained copper-coated magnesium wire 10 was the same 15% as before drawing. The overall specific gravity of the copper-coated magnesium wire 10 was 2.81. The tensile strength was 208 MPa. The conductivity when the conductivity of the copper was 100% was 49.0%. Here, adhesion of the thick copper plating layer was particularly high, and wire drawing was easy as well. The reason is presumably that the zinc film becomes dense by the two zinc substitutions, forming a copper plating layer having high adhesion on the magnesium element wire 10'.

Note that, in this example as well as the examples, reference examples, and conventional example described later, the specific gravity was measured by a specific gravity measuring device (manufactured by Shimadzu Corporation, AUW220D). The tensile strength was measured by a table-top tensile tester (manufactured by Shimadzu Corporation, EZ-Test). The conductivity was obtained by measuring a resistance value by a digital multimeter (manufactured by Advantest Corporation, R6551) using a four-terminal method circuit, and then converting the value to conductivity. The thickness of each layer was measured by a microscope (manufactured by Keyence Corporation, VHX-5000) after polishing the cross section of the wire.

Example 2

In Example 1, the thickness of the thick copper plating was varied to the three types of 7 μm, 45 μm, and 58 μm, and the ratios of each cross-sectional area of the copper coating layer 2' to the total cross-sectional area of the copper-coated magnesium element wire 10' were set to 5%, 25%, and 30%, respectively. All other conditions were the same as in Example 1, and the final copper-coated magnesium wire 10 was obtained.

The ratios of each cross-sectional area of the copper coating layer 2 to the total cross-sectional area of the obtained copper-coated magnesium wire 10 were the same 5%, 25%, and 30%, respectively, as before drawing. The overall specific gravities of the copper-coated magnesium wires 10 were 2.10, 3.61, and 3.89, respectively. The tensile strengths were 203 MPa, 213 MPa, was 215 MPa, respectively. The conductivities when the conductivity of the copper was 100% were 43.0%, 55.0%, and 58.0%, respectively. Based on the results of Example 1 and Example 2, each copper-coated magnesium wire had a tensile strength about as high as the tensile strength of copper, and the overall specific gravity and conductivity of the copper-coated magnesium wire were successfully adjusted by controlling the ratio of the cross-sectional area of the copper coating layer. As a result, it was possible to obtain the copper-coated magnesium wire 10 that is light in weight, favorable in conductivity, high in strength, and thus preferred as a coil wire material.

Example 3

In Example 1, zinc substitution with zincate treatment was carried out once, and thus degreasing, etching, desmutting, zinc substituting, strike copper plating, and thick copper plating were performed, in that order. Each treatment and all other conditions were the same as in Example 1, and thus the copper-coated magnesium element wire 10' having a diameter of 0.65 mm was prepared. Subsequently, wire drawing was performed in the same manner as in Example 1, and the final copper-coated magnesium wire 10 was obtained. While the adhesion of the thick copper plating layer here was slightly lower than in Example 1, wire drawing could be also performed unproblematically.

Reference Example 1

An AZ-based magnesium alloy element wire containing 3% Al-1% Zn of an AZ31 alloy (ASTM symbol) was used in place of the magnesium wire used as the magnesium element wire 1' in Example 1. All other conditions were the same as in Example 1, and a copper-coated magnesium alloy wire drawn to a final diameter of 0.08 mm was prepared.

The ratio of the cross-sectional area of the copper coating layer to the total cross-sectional area of the obtained copper-coated magnesium alloy wire was the same 15% as before drawing. The overall specific gravity of the copper-coated magnesium alloy wire was 2.86. The tensile strength was 290 MPa. The conductivity when the conductivity of the copper was 100% was 30.7%. While the specific gravity was the same level as that of the copper-coated magnesium wire obtained in Example 1, the conductivity was decreased to approximately 18%.

Reference Example 2

Similar to Example 2, in Reference Example 1 the thickness of the thick copper plating was varied to the three types of 7 μm, 45 μm, and 58 μm, and the ratios of each cross-sectional area of the copper coating layer to the total cross-sectional area of the copper-coated magnesium alloy element wire were set to 5%, 25%, and 30%, respectively. All other conditions were the same as in Reference Example 1 and Example 1, and a final copper-coated magnesium alloy wire was obtained.

The ratios of the cross-sectional area of each copper coating layer to the total cross-sectional area of the obtained copper-coated magnesium alloy wire were the same 5%, 25%, and 30%, respectively, as before drawing. The overall specific gravities of the copper-coated magnesium alloy wires were 2.15, 3.66, and 3.93, respectively. The conductivities when the conductivity of the copper was 100% were 22.6%, 38.9%, and 43.0%, respectively. Based on the results of Reference Example 1 and Reference Example 2, the overall specific gravity and conductivity of each copper-coated magnesium alloy wire were successfully adjusted by controlling the ratio of the cross-sectional area of the copper coating layer. However, the conductivities were considerably small compared to those of the copper-coated magnesium wire 10 obtained in Examples 1 and 2, and thus the wires were inadequate as a coil wire material having favorable conductivity.

Conventional Example 1

A pure aluminum wire was used in place of the magnesium wire used as the magnesium element wire 1' in Example 1. All other conditions were the same as in Example 1, and a copper-coated aluminum wire drawn to a final diameter of 0.08 mm was prepared.

The ratio of the cross-sectional area of the copper coating layer to the total cross-sectional area of the obtained copper-coated aluminum wire was the same 15% as before drawing. The overall specific gravity of the copper-coated aluminum wire was 3.63. The tensile strength was 108 MPa. The conductivity when the conductivity of the copper was 100% was 66.9%. While the specific gravity was greater than that of the copper-coated magnesium wire obtained in Example 1 and the tensile strength was considerably small, the conductivity was high.

DESCRIPTIONS OF REFERENCE NUMERALS

1 Core material
1' Magnesium element wire
2 Copper coating layer
2' Copper coating layer
3 Insulating coating layer
10 Copper-coated magnesium wire
10' Copper-coated magnesium element wire

What is claimed is:

1. A copper-coated magnesium wire, comprising:

a core material made of magnesium; and a copper coating layer made of copper or a copper alloy provided on a surface of the core material, the copper coating layer having a thickness that is less than or equal to 6.5 μm, wherein the copper coating layer comprises a surface with wire drawing marks; and the copper-coated magnesium wire has a diameter within a range of 0.03 to 0.08 mm, inclusive.

2. The copper-coated magnesium wire according to claim 1, wherein the copper coating layer has a thickness within a range of 5 to 30%, inclusive, as a ratio of the overall cross-sectional area.

3. An insulated wire, comprising:

the copper-coated magnesium wire according to claim 1, and an insulating coating layer provided on an outer circumferential side of the copper coating layer.

4. A copper-coated magnesium wire, comprising:

a core material made of magnesium; and a copper coating layer made of copper or a copper alloy provided on a surface of the core material, wherein the copper coating layer comprises a surface with wire drawing marks; and the copper-coated magnesium wire has a diameter within a range of 0.03 to 0.08 mm, inclusive, and the copper coating layer has a thickness within a range of 5 to 30%, inclusive, as a ratio of the overall cross-sectional area.

5. An insulated wire, comprising:

the copper-coated magnesium wire according to claim 4, and an insulating coating layer provided on an outer circumferential side of the copper-coating layer.

* * * * *